United States Patent [19]

Meyer et al.

[11] Patent Number: 4,671,800

[45] **Date of Patent: * Jun. 9, 1987**

[54] LOW RANK AND WASTE COAL DERIVED FUEL COMPOSITIONS AND METHOD OF MANUFACTURE OF SUCH COMPOSITIONS

[75] Inventors: Edmond G. Meyer, Laramie, Wyo.; Lee G. Meyer, Englewood, Colo.

[73] Assignee: Carbon Fuels Corporation, Englewood, Colo.

[ * ] Notice: The portion of the term of this patent subsequent to Oct. 9, 2001 has been disclaimed.

[21] Appl. No.: 658,878

[22] Filed: Oct. 9, 1984

Related U.S. Application Data

[63] Continuation-in-part of Ser. No. 427,937, Sep. 29, 1982, Pat. No. 4,475,924, which is a continuation-in-part of Ser. No. 247,382, Mar. 24, 1981, abandoned.

[51] Int. Cl.[4] ..... C10L 1/32

[52] U.S. Cl. ..... 44/51; 44/1 R; 44/1 SR; 44/47

[58] Field of Search ..... 44/51, 1 SR

[56] References Cited

U.S. PATENT DOCUMENTS

| | | | |
|---|---|---|---|
| 4,192,651 | 3/1980 | Keller | 44/51 |
| 4,208,251 | 6/1980 | Rasmussen | 44/51 |
| 4,443,230 | 4/1984 | Stellaccio | 48/197 R |
| 4,475,924 | 10/1984 | Meyer | 44/51 |
| 4,490,156 | 12/1984 | Marion et al. | 48/61 |
| 4,491,456 | 1/1985 | Schlinger | 48/197 R |

*Primary Examiner*—Jacqueline V. Howard
*Attorney, Agent, or Firm*—Lee G. Meyer

[57] ABSTRACT

Coal char, preferably produced by the pyrolytic destructive thermal distillation in the absence of oxygen of carbonaceous materials selected from lignites, peats, low rank coals, and waste coals, is beneficiated, ground and sized and then is admixed in suitable proportions with a liquid organic fraction to form a combustible, liquid/solid fuel system which is a nonpolluting, stable, transportable, high energy fuel compositions. The lower rank coals and peats are mechanically and/or thermally dehydrated prior to pyrolysis. Waste coals are beneficiated prior to pyrolysis. At least part of the liquid organic fraction is obtained from the pyrolysis of the carbonaceous material. Both the solid and the liquid portions can be used independently as fuel, or the solid/liquid fuel system can be fired directly.

39 Claims, No Drawings

LOW RANK AND WASTE COAL DERIVED FUEL COMPOSITIONS AND METHOD OF MANUFACTURE OF SUCH COMPOSITIONS

DESCRIPTION

1. Technical Field

This application is a continuation-in-part of U.S. patent application Ser. No. 427,937 filed Sept. 29, 1982, now U.S. Pat. No. 4,475,924 issued Oct. 9, 1984, which is a continuation-in-part of U.S. patent application Ser. No. 247,382 filed Mar. 24, 1981, now abandoned. The parent application which is incorporated in its entirety by reference as if it were completely set out herein, discloses a transportable fuel system as well as completely combustible, transportable fuel compositions derived from coal, which compositions contain particulate coal char, and methods for making such a system.

The instant invention relates to fluidic transportable fuel systems and fuel compositions, which fuel systems are completely combustible and contain particulate coal char derived from solid carbonaceous fuels such as waste coal, lignite lower rank coals, peat and the like. More particularly, this invention relates to high energy, non-polluting, transportable fluidic fuel systems which are derived substantially from low rank and waste coal and methods for using such systems. In one aspect, the fluidic fuel is fired directly into a liquid-fueled system. In another aspect, the transportable fuel composition forms a fuel transport medium wherein some to substantially all of the particulate solid is separated from the hydrocarbon liquid component and one or both of the constituents used as fuels and/or the liquid organic material from which the solid has been separated is used as a feedstock. In a further aspect, a portion of the char and/or the liquid organic fraction is used directly as a combustion fuel prior to producing the transportable fuel system. Advantageously, the char is admixed with a portion of the liquid organic material, preferably a higher boiling fraction, to produce a solid fuel with enhanced combustion characteristics and reduced explosion hazard.

2. Background Art

Although over 200 billion tons of economically recoverable coal exist in this country, there is a substantially greater amount of coal which is not presently economically recoverable, yet represents a viable energy source. These coals generally contain too much moisture or are low in Btu or are too high in sulfur or other pollutants to be economically usable as fuels in the current energy market. Even though some of the lower rank coals and peats contain substantial amounts of moisture, and therefore contain lower per unit Btu heat value, they nevertheless contain substantial quantities of "volatile matter" which, on a dry basis, is high in per unit heat value.

Heretofore, the lignites, peats and lower calorific value subbituminous coals have been economical only in mine mouth power generation facilities. Low rank coals have not had an economic use except in the vicinity of the mine site. This is due primarily to the cost of shipping a lower Btu product as well as to the danger of spontaneous combustion because of the high content of volatile matter and high percentage of moisture which is characteristic of such coals. Utilization at the mine site to produce electricity is not always efficient due to transmission and/or conversion losses. A further attendant problem with the use of low Btu solid fuels generally, and lignites especially, is that they do not contain the same mixtures of constituents, thus requiring specific boiler design to burn from a particular deposit.

Due to unstable oil supply and the negative balance of "energy" trade in recent years, many techniques have been developed to effectively utilize low rank coals. In effective utilization of the low rank coals, one important aspect in solving transportation and energy efficiency problems has been reduction of the high moisture content. Low rank coals can generate 6,000 to 7,000 k cal/kg on a completely dehydrated basis, but the 20–70% moisture content causes lowering of the calorific value (heat value) per unit weight, as well as making long haul transport uneconomical. To solve these problems, dewatering or dehydration of low rank coals has been considered but has been deemed uneconomical because of the tremendous amount of energy required for evaporating the moisture and because of the risk of producing minute powders of dehydrated coal which can cause spontaneous combustion. Dehydration of low rank coals by nonevaporation methods, i.e., separation of moisture by heating the coal with steam or highly heated water under high pressure, has also been considered. This method is somewhat more diffieult and utilization of the dehydrated product is less economical because the process also reduces the amount of volatiles in the dehydrated product.

Since low rank coals contain high percentages of volatile matter, they retain the risk of spontaneous combustion after dehydration even by the nonevaporation method. Therefore, in order to secure stability of the dehydrated coal in storage and transportation, it has been necessary to cover the coal with an atmosphere of inert gas such as nitrogen or combustion gas, or to coat it with crude oil so as not to reduce its efficiency as a fuel. However, the use of an inert gas is not economical because of its production energy requirement. The method of coating the dehydrated coal with crude oil has proven effective in preventing both spontaneous combustion and the creation of coal dust during transportation. Heretofore this method has also been uneconomical because the crude oil must be purchased and transported to the dehydration facility.

Waste coal has somewhat different inherent problems from those of the low rank coals. Waste coal is sometimes referred to as "non-compliance coal" because it is too high in sulfur per unit heat value to burn in compliance with the EPA standards. Other waste coal is too low in Btu to be transported economically. This coal represents not only an environmental problem (because it must be buried or otherwise disposed of), but also is very economically unattractive. It must be mined in order to reach the marketable coal, rehandled and finally disposed of. The average cost per ton to handle this waste material is about three times the cost of handling marketable coal, yet the waste coal cannot be sold to produce revenues.

Thus, it would be highly advantageous to have a completely combustible fluidic fuel system which is easily and efficiently prepared from lower rank coals, waste coal, lignites or peat using no external water and which fuel system would be (a) transportable using existing pipeline, tank car and tankership systems, (b) burnable either directly as a substitute for oil in substantially all existing oil-fired combustion systems with little or no equipment modification or separable at the destination to provide a liquid hydrocarbon fuel or feedstock and a burnable char, (c) a uniform combustion product regardless of the region from which the carbonaceous feedstock material is obtained, (d) high in BTU content per unit volume, (e) low in ash, sulfur and nitrogen, (f) high in solid loading and stability and (g) free of polluting process by-products which would have to be disposed of at the production site or at the destination.

DISCLOSURE OF THE INVENTION

The parent application disclosed a transportable fuel system which contains particulate coal char and methods for making such compositions. It was further disclosed in the parent application that carbonaceous materials such as lignite, low rank coal and the like could be used as feed materials to produce such fuel systems. It has now been discovered that the lignite coals, i.e., those coals containing in the range from about 35% to about 50% moisture and in the range of from about 35% to about 55% volatile matter (on a moisture-free basis), soft coals, peat and waste coals can be economically utilized to produce the transportable fuel containing particulate coal char by treating the coal to reduce moisture and/or pollutants. A fluidic, completely combustible fuel system comprising a particulate coal char and a liquid organic material provides a pipeline transportable fuel composition which has high BTU per unit volume, is low in pollutants, and is a substitute for petroleum derived fuels in liquid-fueled combustion systems with little or no equipment modification or can be separated at the destination to provide a combustible solid as a fuel for solid-fueled combustion devices and a liquid hydrocarbon for use in liquid-fueled combustion devices or as a feedstock.

In the broad aspect of the invention, a liquid-solid mixture includes a particulate coal char portion, derived by pyrolysis of lignites, lower rank coals, peats and waste coals, dispersed in a liquid organic material to create a composition which has fluidic characteristics such that it can be transported by certain existing pipeline facilities and used directly in external combustion systems. In one aspect, the liquid/solid mixture is a substitute for oil in oil-fired combustion devices. In another aspect, some or substantially all of the particulate coal char is separated from the fuel system at the destination for use as a fuel in char- or coal-fired combustion devices and the remaining liquid organic material is utilized as a feed stock or as a high quality liquid fuel for oil fired combustion devices. In a further aspect, the hydrocarbon-rich liquid organic fraction which is not admixed with the char can be used directly as a substitute for oil in liquid-fueled combustion devices or as a feedstock. Likewise, that portion of char which is not admixed with the liquid organic fraction can be used directly as a feed for solid-fueled external combustion devices.

In accordance with the invention, peat, lignites, waste coals, and lower rank coals are pretreated prior to pyrolysis to provide an economically efficient process and a compliance, high Btu product. In the case of peats, lignites and those coals containing a substantial amount of moisture, the material to be pyrolyzed is first subjected to mechanical and/or thermal treatment to reduce moisture. Advantageously, this is practiced in a continuous process whereby the process heat from the pyrolysis is used to dehydrate the feedstock material. In another aspect wherein the feedstock is high in ash, sulfur or other inorganic pollutants, the material is beneficiated either as a coal or as a char, as further set out herein.

In accordance with another aspect of the instant invention, the particulate coal char which is separated from the slurry can be admixed with raw coal, upgraded coal, petroleum coke and the like to yield a high BTU, reduced pollutant fuel for char- or coal-fired combustion devices. Likewise, the liquid hydrocarbon can be used itself as a fuel or admixed with a liquid petroleum distillate or alcohols, such as those produced from grains or the synthesis of coal, in order to vary the characteristics of the liquid as a fuel or as a feedstock.

The liquid organic fraction is derived during the pyrolysis or hydropyrolysis of the coal. It may be further hydrogenated to alter the viscosity. Advantageously, the liquid organic fraction is beneficiated. The fuel composition of the instant invention can be produced by subjecting coal to pyrolytic or hydropyrolytic destructive distillation in the absence of oxygen to produce a particulate coal char which is advantageously admixed in suitable proportions with a liquid organic fraction to produce a solid/liquid fluidic mixture, i.e., a slurry.

In accordance with one aspect of the invention, the fluidic fuel composition is produced by first pretreating lower rank coals to reduce moisture and/or inorganic pollutants, then subjecting these pretreated coals to pyrolytic or hydropyrolytic destructive thermal distillation in the absence of oxygen to produce a particulate coal char. The char is sized and otherwise mechanically and thermally processed to yield a particulate coal char of a distribution to advantageously effect loading of the solid. The liquid organic fraction obtained from the pyrolysis or hydropyrolysis of coal is admixed with the particulate char in proportions so as to form at least a portion of the fluidic, solid/liquid, completely combustible fuel mixture suitable for pipeline transport and combustion directly in combustion systems. Advantageously, this liquid organic fraction may be hydrotreated to reduce viscosity and beneficiated to remove sulfur or nitrogen pollutants.

In accordance with another embodiment, the particulate coal char is admixed with a lower chain alcohol, or mixtures of such an alcohol with the liquid organic fraction, which alcohol is preferably produced by well known synthetic methods utilizing coal and water or natural gas. In accordance with a greatly preferred embodiment, the alcohol is produced from the gases liberated in the pyrolysis process, thus producing all the fuel system components from a single, completely self-contained process system.

The utilization of a particulate char allows a high packing of the solid particulate matter for a given fluidity of the mixture. Thus, not only does one obtain the aforementioned advantages, but the energy requirement necessary to pump each BTU of fuel energy is significantly reduced. In a further advantageous embodiment, the char is ground and sized to yield a particulate distribution which is bimodal or trimodal. The use of a bimodal or trimodal particulate char distribution enhances the packing of the solid.

In accordance with another embodiment of the instant invention, an amount of pulverized coal, which may be lower rank coal, waste coal or upgraded and dehydrated coal, is added to the particulate coal char/-liquid organic fraction slurry. In accordance with this embodiment, the coal is pulverized so as to provide bimodal or trimodal packing with the char. This improves the combustion characteristics of the solid portion of the slurry in some combustion applications without the expense of processing all the coal by pyrolysis. The amount of coal which is added is effective to improve the combustion characteristics without adversely affecting the beneficial aspects of the particulate coal char/liquid organic material admixture. Addition of coal to the slurry prior to transport is economically attractive in that grinding and sizing facilities at the slurry preparation site already exist.

In addition to the char and the liquid organic fraction, which is substantially hydrocarbon rich material, the pyrolysis or hydropyrolysis produces gaseous products. These gases contain lower chain hydrocarbons, hydrogen, carbon monoxide and other combustibles plus ammonia, sulfurous compounds and nitrogenous compounds. The gases are useful for the extraction of marketable by products such as ammonia, and for use as a hydrogen source for hydropyrolysis, as a fuel for use in combustion systems and, most importantly, as a feedstock for the production of lower chain alcohols for use as hydrocarbon slurrying liquids. Advantageously, the pyrolysis gases are "sweetened" prior to being marketed or used in the process. The elimination of potential pollutants in this manner not only enhances the value of the char and liquid organic fraction as non-polluting fuels but also improves the economics of the process as the gaseous products may be captured and marketed or utilized in the process. In accordance with a preferred embodiment, these gases are used primarily to produce lower chain alcohols which are admixed with the liquid organic material to improve the viscosity characteristics of the liquid organic fraction.

In accordance with the instant invention, the fuel system, which advantageously comprises the transportation medium for the fuel to its end use, can be injected directly into the combustion chamber of an external combustion system in the presence of sufficient oxygen and heat to initiate and sustain combustion. The combustion products are then exhausted from the combustion chamber. Alternatively, some or substantially all of the solid can be removed from the fuel system and, either as the sole fuel or in an admixture with coal, fired directly into char- or coal-combustion devices. The remaining liquid organic material which contains the residual particulate coal char can be further used as a transportation medium to deliver the slurry for use as an oil-fired combustion fuel or as a feed stock.

Further, in accordance with another aspect of the instant fuel system, those liquid organic fractions and/or solids which are not slurried can each be used directly as a fuel for external combustion devices or, in the case of the liquid organic fraction, as a feedstock. The liquid organic fraction not utilized for slurrying the solid can be transported by pipeline to the end-use destination. These hydrocarbon-rich liquids can be transported in the slurry pipeline by using conventional plugs or the like to separate the compositions. Advantageously, these liquid organic materials include lower boiling fractions.

The char which is not utilized for slurrying can likewise be transported by, for example, air conduit for use directly as a solid fuel. Economically, it is burned directly in on-site facilities for process heat and/or electric power generation. In a particularly preferred embodiment when the char, liquid organic material and gas are produced by pyrolysis and/or hydropyrolysis, a portion of the liquid organic material, preferably a higher boiling fraction, is used to treat the char in order to enhance the heat value of the char, to prevent absorption of moisture, to reduce explosion hazard and to facilitate combustion. Likewise, a portion of the dehydrated lower rank coal can be similarly treated and used directly as upgraded coal material without danger of "dusting" or exploding, or can be admixed with the organic fraction to form some or all of the slurry solid. In a further embodiment, the enhanced dehydrated lower rank coal, which may be admixed with a portion of enhanced coal hoar, is compressed to form an agglomerated or pelletized solid fuel product.

BEST MODE FOR CARRYING OUT THE INVENTION

The method of manufacture of the instant fuel system is fully set out in the parent application of which this is a continuation-in-part. The parent application discloses that the fuel system can be utilized as a fuel composition either directly as the solid/liquid slurry or as a system which is separable into its solid and liquid components, with each constituent useful independently as a fuel or, in the case of the liquid component, a feedstock. In the interest of brevity, that application has been incorporated herein.

In accordance with the preparation of the particulate coal char/liquid organic material slurry that is utilized in accordance with the instant invention, waste coal, lignite and/or peat are subjected to pretreatment to reduce moisture and/or inorganic pollutants. It will be realized in accordance with this invention that certain organic and inorganic pollutants as well as moisture are removed from the feedstock during pyrolysis in accordance with the instant process, regardless of the pretreatment. For example, organic sulfur is efficiently removed from the liquid hydrocarbon fraction during treatment of the liquids. Likewise, pre-heating of the coal prior to pyrolysis drives off substantial inherent moisture to "dry" the coal for pyrolysis. Therefore, pretreatment as set forth herein need be effected only for those coals which, because of "excess" moisture and/or pollutants are not economically handled during the normal pyrolysis/beneficiation steps.

In accordance with the instant invention, those lower rank coals having moisture content in excess of 40% by weight and/or waste coals are continuously crushed to particles in the range of $\frac{1}{2}''$ to $\frac{1}{4}''$ in diameter to produce a crushed coal product. Advantageously, the crushed coal is then beneficiated by means well known in the art to remove inorganics. This process and the size of the coal particle to be beneficiated will be dependent on the rank of the coal, its agglomerating tendencies and the inorganic sulfur and ash content of the coal. In the case of coal containing excess moisture, the coal is then subjected to mechanical pressure, such as an auger screw, compressing rollers or the like to liberate excess moisture which is gathered to be used as process water for pyrolysis. The mechanically dehydrated material is then subjected to thermal processing, preferably at reduced pressures, to liberate further water and entrained volatiles which are collected for later use in the pyrolysis step. In accordance with a greatly preferred embodiment, "superheated dry steam" is used to pretreat and dehydrate the preheated coal. The crushed, pretreated coal is then hydropyrolyzed in the presence of this steam under temperatures and pressures and in accordance with process conditions to produce a particulate coal char. The pyrolytic destructive distillation produces a particulate char portion and a liquid organic fraction. Advantageously, the char portion may be further beneficiated to remove inorganic pollutants and mechanically and thermally treated to size the particulate char product which is efficacious for bimodal and trimodal packing. The sized char mixture is then ready to be slurried.

The liquid organic fraction derived during the pyrolysis of the coal may be advantageously separated by fractional distillation into a higher boiling fraction containing the bulk of the nitrogen and a lower boiling fraction. The higher boiling fraction can be further hydrogenated to decrease viscosity or sent to storage for use directly as a chemical reagent and feed stock. In accordance with one aspect, at least a portion of the higher boiling fraction is admixed with the char to form an enhanced solid fuel for use, without slurrying, directly in, for example, a solid-fueled combustion system. The lower boiling fraction is rendered substantially free of combined and entrained materials which, on combustion, would produce sulfur oxides, nitrogen oxides and like pollutants. The lower boiling fraction can be distilled to remove gasoline and other valuable hydrocarbon fractions which can be used directly as transportation fuels.

The remaining lower boiling fraction is added to the upper boiling fraction which has been hydrogenated and beneficiated for use as the medium to slurry the particulate coal char. The exact mixture of liquid to solid will depend on a number of factors such as the characteristics of the liquid-fueled external combustion device in which it is to be used, the transportation medium limitations and the like. The transportable, particulate coal char/liquid organic fraction, fluidic fuel composition is passed to storage for later distribution by pipeline or tanker vehicle in a manner similar to crude oil.

The coals that can be employed in accordance with the instant invention are, generally, those coals of lower rank such as lignites and peats as well as non-compliance and waste coals, which will undergo pyrolysis to form a particulate coal char. As waste coal is used herein, it refers to carbonaceous material which is, under present economic and environmental conditions, not merchantable, i.e., that coal which is either not mined because of quality or is wasted during the mining process. In accordance with one aspect of the instant invention where the slurry liquid organic fraction is derived from the pyrolysis or hydropyrolysis, it will be realized by the skilled artisan that coals having lower percentages of volatiles will require use of alcohols or other "make-up" hydrocarbons to produce the pipeline transportable compositions of the instant invention. Preferably, coal from the lignite rank to the medium volatile bituminous have sufficient volatiles so as to minimize make-up hydrocarbons. When lignites are utilized, they are advantageously subjected to pretreatment to remove residual water as previously described. Lignites are an advantageous starting material for the instant invention in that they contain process water for hydropyrolysis as well as volatiles up to 55% by weight (on a dry basis). This is advantageous in producing char slurries having higher liquid content.

The physical properties of the coal are also important in the practice of the instant invention. Those coals known as caking or agglomerating coals tend to form "cokes". Other coals of higher rank have plasticity and free swelling characteristics which tend to cause them to agglomerate and slake during the pyrolysis process. These coals must be subjected to special charring and treatment conditions as further set out herein to produce the particulate coal char suitable for use in accordance with the instant invention.

The mining and preparation of coal is fully described in Kirk-Othmer ENCYCLOPEDIA OF CHEMICAL TECHNOLOGY, second edition, Anthony Standin, editor, Interscience Publishers, New York, 1969, vol. 5, pp. 606–676. The coal is mined from a coal mine by either strip or underground methods as appropriate and well known in the art.

The raw coal is preferably subjected to preliminary crushing to reduce the particle size. Particle sizes of from $\frac{1}{4}''$ to about $\frac{1}{2}$ in lateral dimension (diameter) are found useful but the actual sizing is dependent on the properties of the coal as well as the need for beneficiation. The need for size reduction and the size of the reduced material will depend upon the process conditions utilized as well as the composition and rank of the coal material. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the pyrolysis techniques and process conditions in order to produce a particulate coal char and to prevent slagging and/or agglomeration during pyrolysis. The crushing and/or grinding is preferably accomplished with impact mills such as counter-rotating cage mills, hammer mills or the like. The crushed coal is sized by, for example, rough screening and gangue material is removed to assure a more uniform product for pyrolysis. Advantageously, carbonaceous fines and the like are readily utilized and subjected directly to pyrolysis or hydropyrolysis.

When lignites or peats are utilized, the raw coal is subjected to a pretreatment step to remove excess moisture. In accordance with one embodiment, coal is subjected to mechanical pressure such as in an auger, pressure roller or the like, to mechanically squeeze moisture from the feedstock. The moisture thus liberated is returned as the "process liquid" for pyrolysis. The liberated moisture, depending upon the rank of the coal, will contain higher boiling organics and the like. The feedstock thus treated is then subjected to a preheater which further removes moisture.

In accordance with a greatly preferred embodiment, the pretreated coal particles are passed continuously through a preheater, which is operated in the range of from about 100° C. to about 220° C. at pressures from 0.1 atmospheres to 0.9 atmospheres in order to remove gases and further reduce moisture. In the case of coals of lower rank, vacuum treatment has been found desirable for removal of water and entrained substances. The removed moisture is advantageously used as process water for the hydropyrolysis and/or hydrotreating steps as further set forth herein.

It will be realized, in accordance with the instant invention, that the lower rank coals do not have to be treated mechanically prior to subjecting them to the preheating step. However, it may prove economical to do so. In accordance with another embodiment, superheated "dry" steam, which steam utilizes the moisture previously removed mechanically and/or thermally, is passed continuously over the moisture-laden lower rank coals. Many such steam treatment methods exist in the art. In this manner, the preheated steam removes moisture and volatiles from the feedstock for direct use in steam pyrolysis as further set forth herein. The entrained gases which are removed have further value as fuel or a hydrogen source for the hydropyrolysis step or preferably as a feedstock for production of lower chain alcohols. Advantageously, the preheating is carried out using process heat from the char and hot gases liberated during pyrolysis. The preheating is preferably done at lower temperatures to minimize slagging and agglomeration.

Pyrolysis, as used herein, means the destructive distillation of coal in the absence of oxygen, and may be performed in the presence of one or more hydrogen donors or hydrogen itself. "Pyrolysis" thus includes pyrolysis, hydropyrolysis, and steam pyrolysis as well as carbonization techniques under varying temperature and pressure and atmosphere conditions such as, for example, in the presence of hydrogen, water vapor or hydrogen-donating material. The pyrolysis step of the instant invention can be carried out by any pyrolysis apparatus, which is well known in the art, having the ability to reach charring temperatures in the requisite time. For example, with pretreated lignites and peats, temperatures should be in the range of from about 400° C. to about 800° C. and a heating rate of from about 1.5° C. per second to about 2.5° C. per second should be employed. Coals of higher rank require progressive heating at rates which prevent agglomeration and at higher final temperatures in the range of 1000° C. depending on the atmospheric pressures. It will be realized by the skilled artisan that, depending on the composition of the charge, the residence time, the pyrolysis process used and the charring furnace utilized, the temperatures and rates may vary. Preferably, the pyrolysis is performed in a continuous process.

As the crushed coal is heated in the absence of oxygen, the entrained materials are vaporized and collected. Lower boiling organic fractions including hydrocarbons, cyclics, and aromatics as well as higher boiling organic fractions are emitted from the coal leaving a particulate char material of essentially carbon which is of a porous structure and substantially spherical in shape. Included in the emitted constituents are the nitrogen containing polluting compounds such as pyridine, piperazine and the like.

The preferred method of thermal destructive distillation in the absence of oxygen is hydropyrolysis. Hydropyrolysis is advantageously employed when treating coal containing a lower percentage of volatiles or when a higher percentage of hydrocarbon liquids is desired. In accordance with this process, the pyrolysis is carried out in the presence of a hydrogen containing source which may be water or, advantageously, the pyrolysis gases which are subjected to standard phase shift reactions.

In accordance with a greatly preferred embodiment, steam pyrolysis is used with a presoak step to liberate volatiles. When coals of lower rank are used, the steam treatment to liberate moisture and volatiles may be advantageously integrated with the presoak step. When steam hydropyrolysis is used, it has been found advantageous to subject the coal to pretreatment by holding the coal in the presence of an atmosphere having a partial pressure of steam, and preferably a water saturated atmosphere, at pressures of from about 20 to about 60 atmospheres for resident times in the range of from 15 to about 45 minutes with 30 minutes being preferred, at temperatures in the range of from about 200° C. to about 400° C. This is followed by hydropyrolysis at the same steam pressures and temperatures of from about 400° C. to about 1000° C. with temperatures in the range of from about 600° to about 800° C. being preferred for subbituminous coals. By a mechanism which is not fully understood, the steam pretreatment appears to enhance the hydropyrolysis step and increase the liquid yield as well as enriching the hydrocarbon partial pressure of the liberated gases. Thus the advantage of using this method will be determined by the rank of the coal to be used as well as the rheology of final slurry product desired. The viscosity and percent loading of the fuel of the instant invention will be determined primarily by the characteristics of the transportation and combustion systems.

The liquids hydrotreating step is quite well developed. A number of such technologies are readily available in the art. The parametric aspects of the pyrolysis conditions determine the char yield and the yield and composition of the liquids. Of the numerous pyrolysis technologies available, the pyrolysis/hydrotreater is deemed preferable when the liquid organic fraction is to be further treated to adjust viscosity since it allows the sequential pyrolysis of coal and hydrotreating of the liquid. In the case of lower ranked coals, hydrotreating is usually not necessary. In each case, the paramount consideration is to obtain a maximum amount of liquids having a viscosity consistent with producing a slurry that is capable of pipeline transport and of loading a maximum of a particulate solid coal char while being combustible in oil fired combustion systems.

In practicing the process of the instant invention in a continuous mode, it has been determined that recycling the hot char to the pyrolyzer conserves energy and has a beneficial effect on the pyrolysis products. The reactor temperature and the residence time are variable factors used to produce greater yields of char and/or liquid organic material, as well as obtaining a hydrocarbon mix of desirable viscosity. The process can be "fine tuned", depending on which slurry factors are more important and on the rank of the coal (i.e., percent volatiles, agglomeration, etc.). For example, if some of the particulate char is to be separated at the destination for use as a solid combustion fuel, higher loading factors may be desired in order to maximize the transportation of solid char.

If the slurry is to be fired directly into a liquid fueled combustion device, the loading and the liquid organic constituents and the viscosity of the liquids may be varied to maximize boiler efficiency, and, in some cases, amounts of alcohol and "make up" hydrocarbon distillates can be added effective to enhance combustion characteristics in a particular combustion system configuration as well as pumping characteristics of the slurry. Liquid petroleum distillates which can be used include fractions from petroleum crudes or any artificially produced or naturally occurring hydrocarbon compound which is compatible with the coal-derived liquid organic hydrocarbon containing portion used as the slurry medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxy-containing aliphatic-substituted aromatics. The aliphatics disclosed herein are intended to include both saturated and unsaturated compounds and their stereo-isomers. Particularly preferred are the lower chain alcohols including the mono-, di- and trihydroxy compounds. Preferably, the make-up hydrocarbons do not contain mercaptal, sulfate, sulfite, nitrate, nitrite or ammonia groups.

The char may be efficaciously sized and beneficiated. When dealing with waste coals having higher percentages of inorganic pollutants such as sulfur or ash, beneficiation of both the coal and the char should be considered. The char may be beneficiated. When beneficiation is indicated because of the inorganics present, beneficiation may be utilized to clean either the coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, flotation, chemical reaction, solvent extraction, oil agglomeration (for coal only) and/or electro-static separation. The latter three methods remove both ash and pyritic (inorganic) sulfur. When the solvent extraction or oil agglomeration methods are used, it is most advantageous to utilize, as the beneficiating agent, the liquid derived from the pyrolysis process. The exact method employed will depend largely on the coal utilized in forming the char, the conditions of pyrolysis, and the char size and porosity.

The chars which can be utilized in accordance with the instant invention have a high reactivity and surface area, providing excellent Btu to weight ratios. They are particulate in nature as distinguished from the larger, "structured" particles of the prior art. The char particles are sufficiently porous to facilitate beneficiation and combustion but the pore size is not so large as to require the use of excessive liquid for a given amount of solid. The spherical shape allows adjacent particles to "roll over" one another, therefore improving slurry rheology and enhancing the solid loading characteristics. Preferably, chars that can be employed are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably, 200 mesh.

It is very important, in order to obtain the requisite liquid/solid mixture, that the coal char be discrete, particulate char. When utilizing agglomerating or "caking" coals, preferably the process parameters are regulated so as not to produce an agglomerated product as previously set forth herein. Further, the coal char material may be emitted from the charring apparatus as discrete particles which are stuck together depending on the starting material and the pyrolysis conditions utilized. Therefore. the char material is ground to yield the substantially spherical, properly sized particulate coal char. Any conventional crushing and grinding means, wet or dry, may be employed. this would include ball grinders, roll grinders, rod mills, pebble mills and the like. Advantageously, the particles are sized and recycled to produce a desired distribution of particles. This is a very important aspect of the instant invention. The char particles are of sufficient fineness to pass a 100 mesh screen and the majority of the particles pass a 300 mesh screen. The mesh sizes refer to the Tyler Standard Screens. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel into liquid-fueled combustion systems. The exact distribution of particle sizes is somewhat empirical in nature and depends upon the characteristics of the liquid organic fraction.

The ground, beneficiated char can be sized by any apparatus known in the art for separating particles of a size on the order of 100 mesh or less. Economically, screens or sieves are utilized, however, cyclone separators or the like can also be employed. In sizing, selections are made so as to assure a stable, pipeline transportable slurry and uniform combustion. A distribution of particle size is chosen to effect so called "modal" packing. The spheroid shape of the primary particle provides spacing or voids between adjacent particles which can be filled by a distribution of second or third finer particle sizes to provide bimodal or trimodal packing. This modal packing technique allows addition of other solid fuel material such as coal to the slurry without affecting the very advantageous pumping characteristics of the particulate coal char/liquid organic fraction slurry of the instant invention. Additionally, this packing mode allows the compaction of substantially more fuel in a given volume of fuel mixture while still retaining good fluidity.

The resultant sized, particulate coal char mix may be conveyed by means of, for example, an air conduit to be "slurried" in appropriate proportion with the organic fraction.

The liquid organic fraction may be hydrotreated and/or beneficiated, as necessary, to provide a lower viscosity, pollutant free, hydrocarbon containing organic fraction. The exact amount of this fraction utilized will depend upon the properties of the combustible particulate coal char-containing admixture which are desired. Normally, fractions having boiling points of about 200° F. have been found useful for the instant invention. In accordance with a preferred embodiment, the low boiling transportation fuels such as aviation gasoline, kerosene, naptha and the lighter diesel fuels are separated from the liquid organic fraction prior to slurrying with the particulate coal char. These transportation fuels, which are pipeline transportable, can be marketed separately, thereby improving the economics of the process.

The higher boiling fractions of the liquid organic fraction may contain certain sulfur and nitrogen compounds. This fraction may be removed by fractional distillation and used directly as a feedstock for chemical synthesis. Alternatively, it may be hydrotreated and beneficiated by methods well known in the art to reduce the viscosity and remove pollutants. Thus this liquid organic fraction is available as additional slurry liquid. Advantageously, the pyrolysis and hydrotreating can be accomplished sequentially, followed by beneficiation in accordance with the procedure previously disclosed herein.

The particulate char and the lower viscosity pollutant-free organic fraction and the hydrotreated higher boiling fraction are admixed in the desired portion to form a slurry. An admixture is thus formed of a particulate coal char and the organic liquid constituent having a ratio of particulate char to liquid which is dependent upon the properties of the slurry desired.

The terms "slurry" or "liquid/solid mixture" as used herein are meant to include a composition having an amount of the particulate coal char which is in excess of that amount which is inherently present in the liquid organic portion as a result of the pyrolysis process. For most applications, however, the particulate coal char constituent should comprise not less than about 45% by weight of the composition and preferably from about 45% to about 75% by weight. In accordance with one aspect wherein the char is separated from the liquid at the slurry destination, the term 'slurry' is intended to include a composition containing amounts of char as low as 1% by weight, which composition may be further transported, for example by pipeline, to a refinery or to another combustion facility.

In accordance with another aspect of the instant invention, particulate char produced from certain ranks of coal have pore sizes and absorption characteristics such as to require treating of the char prior to slurrying of the particulate char with the liquid to reduce absorption by the char of the liquid phase. This treatment serves to stabilize the slurry and prevent absorption by the particulate char of an excess of the slurry liquids. When absorption rates by the char are in excess of about 15%, pretreatment is beneficial. In accordance with this pretreatment, the char is brought into intimate contact with an amount of a the coating or "sealing" material effective to reduce the absorption of liquid by the char. The treatment is effected prior to the particulate char being slurried with the liquid. The sealants or coatings that are useful include organic and inorganic materials which wll not produce pollutants upon combustion nor cause polymerization of the liquid slurry. Since surfactants and emulsifiers are used to enhance slurry stability, care must be taken that the coating or sealant is compatible with the stabilized composition. Sealants and coating materials which are particularly advantageous include parafins and waxes as well as the longer chain aliphatics, aromatics, polycyclic aromatics, aro-aliphatics and the like. Mixtures of various hydrocarbons, such as #6 fuel oil, are particularly desirable because of their ready availability and ease of application. Advantageously, the higher boiling liquid organic fractions from the pyrolysis of the coal are utilized. The sealant or coatings can be applied to the char by spraying, electrostatic deposition or the like.

In accordance with another aspect of the instant invention, a portion of the char produced by pyrolysis of coal can be used directly, without slurrying, as a solid fuel for external combustion devices. Preferably, the char which is not slurried is admixed with an amount of the liquid organic fraction effective to enhance the combustion characteristics of the char yet maintaining the char substantially as a particulate solid matter, i.e., not a fluidic mixture. In this embodiment, preferably the higher boiling "tar" fractions are used. These fractions adhere well to the hot char and provide a "sealant" to prevent moisture absorption during transport. They are also high in heat value per unit volume.

In accordance with another embodiment of the instant invention, coal and water, or more preferably the pyrolysis gases, are utilized to produce methanol and other lower chain alcohols which are utilized as the liquid phase for the combustible fuel admixture of the instant invention. Water released from the coal during preheating can be used as part of the water required in the synthesis, thus further preserving precious resources.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from pyrolysis or natural gas. Advantageously, the alcohol constituent can be produced on site at the mine in conjunction with the pyrolytic destructive distillation. The process heat can be supplied from the pyrolysis step.

In accordance with the process for making these alcohols directly from coal and steam, carbon monoxide and hydrogen are initially formed in accordance with equation I:

$$HOH(steam) + C(coal) \rightarrow CO + H_2. \qquad \text{I.}$$

A portion of the gas is subjected to the shift reaction with steam to produce additional hydrogen in accordance with equation II:

$$CO + HOH(steam) \rightarrow CO_2 + H_2. \qquad \text{II}$$

The $CO_2$ is scrubbed from the gaseous product leaving only hydrogen. The hydrogen is admixed with gaseous products of equation I to produce a gas having desired ratio of hydrogen to carbon monoxide from which methanol and similar products are synthesized catalytically.

In the methanol synthesis plant the respective constituents, such as carbon monoxide and hydrogen, are combined to produce methanol. The synthesis of methanol is described in page 370–398 of vol. 13 of the above referenced KIRK-OTHMER ENCYCLOPEDIA. The carbon monoxide and hydrogen are controlled in a ratio and temperature pressure combination to obtain maximum yields of the methanol fuel product. Other methods for methanol synthesis at lower temperatures and pressures are also known, as for example, the ICI low pressure process as described in "Here's How ICI Synthesizes Methanol at Low Pressure", Oil and Gas Journal, vol. 66, pp. 106–9, Feb. 12, 1968. In accordance with this aspect of the instant invention, the alcohol is used as a portion or substantially all of the liquid phase in the slurry.

In accordance with another aspect of the instant invention, the particulate char solid can be supplemented by an amount of particulate carbonaceous material such as coal, and preferably dehydrated lower rank coals which are advantageously coated with the higher boiling organic pyrolysis fraction. The amount of such material to be added is effective to improve combustion characteristics without detrimentally affecting the beneficial aspects of the uniform combustion slurry product. Specifically, applicant has disclosed that coal-oil mixtures contain coal and, therefore, suffer many of the drawbacks of coal-containing slurries. In accordance with the instant invention, it has been found that certain amounts of particulate carbonaceous material can be added to the particulate coal char/liquid organic fraction slurry with beneficial effect. Carbonaceous material, as used in this aspect, means raw coal of bituminous, subbituminous and anthracite rank as well as upgraded coals, petroleum coke and the like. Preferably, coals containing higher ash and inorganic sulfur are beneficiated by methods disclosed hereinbefore prior to their introduction into the slurry. Upgraded coals include those which have been thermally dried or compressed under heat and mechanical pressure, including coals of lower rank such as peats and lignites as well as those which have been treated, to effect a slight carbonization of the coal (so-called carbonized coal) such as K-Fuel® (process disclosed in U.S. Pat. No. 4,052,168). Surprisingly, where the coal is properly sized and "packed" with the particulate char, the rheology characteristics of the particulate coal char/liquid organic fraction slurry are not greatly affected. Practice of the invention in accordance with this embodiment is advantageous when firing the coal char/liquid organic fraction slurry into external combustion systems in which char, because of its higher ignition point, is not fully combusted. The coal ignition helps to raise the temperature of certain combustion system configurations to facilitate char ignition. Additionally, use of pulverized coal is economically advantageous in that the coal portion of the slurry does not have to undergo pyrolysis. Additionally, since the slurry liquid can be completely derived from coal, there is no preclusion from exporting the admixture. The amount of coal that can be used in accordance with the invention will depend on the particular properties of the coal, but for many applications, up to 70% by weight of the solid constituent of the slurry can be coal and advantageously up to about 50% by weight of the solid.

The mixing (or slurrying) of the solid particles and the liquid can be accomplished by any well known mixing apparatus in which an organic liquid constituent and a particulate coal char can be mixed together in specific proportion and pumped to a storage tank. Advantageously, emulsifying techniques are used, such as high speed empellers and the like. Unlike coal/water slurries and coal/oil mixtures as boiler feeds, the fuel of the instant invention is transportable by pipeline and therefore does not require slurrying equipment at the end-use facility. Thus, even small process heat systems can utilize the fuel of the instant invention efficiently and economically.

The important aspect of the slurry in the instant application is that it is pumpable and stable. This is accomplished by matching the size of the solid char particle, the viscosity of the liquid phase and the stabilizer. Preferably, a small percentage by weight, for example from 1% to about 3%, of water is admixed into the slurry. This is especially preferable when surfactants which have hydrophyllic moieties are used. The slurry is preferably agitated or blended to produce a suspensoid which is stable under shear stress, such as pumping through a pipeline.

It will be realized that, in accordance with the instant invention, surfactants, suspension agents, organic constituents and the like may be added depending on the particular application. Certain well known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose. carboxymethyl cellulose, polyvinyl alcohol and polyacrylamide. As hereinbefore mentioned, advantageously the admixture of the instant invention demonstrates high fluidity. Thus high Btu per unit volume is obtained with lower viscosities and higher fluidities.

As previously set forth, the sizing and packing of the solid is particularly important in obtaining a highly loaded, stable, transportable combustion fuel slurry. It has been found advantageous to have greater than about 50% of the solid material smaller than about 100 mesh (Tyler) and over about 80% of that passing a mesh size in the range of 300 (Tyler). Preferably, the viscosity of the liquid organic fraction is in the range of from 17° API to about 20° API. This will of course depend on the loading and pumping characteristics desired, the stabilizers used, whether coal and/or alcohol are present in the slurry in accordance with the instant invention. The degree API is very important in the end use application, i.e., the external combustion system design. Those oil fired systems designed for "heavier" crudes will tolerate more viscous oils and higher loaded slurries.

The fuel composition of the instant invention can be mobilized or transported by all conventional means used for crude oil transportation, permitting the efficacious foreign export of coal derived fuels which has not heretofore been readily and economically accomplished. For example, the existing pipelines to docks and tanking facilities can readily be utilized. Oil tankers can empty their crude oil load in this country, and be refilled with the particulate char-containing fluidic fuel system of the instant invention which can be exported to other nations, thus improving the balance of payments of this country.

The high BTU, non-polluting fluidic fuel system which is completely combustible, upon reaching its ultimate destination, can be employed directly as a substitute for petroleum derived fuels (1) for heating; (2) for power generation; or (3) in mobile combustion units.

Alternatively, the liquid and solid components can be separated so that some to substantially all of the solid portion of the slurry is removed from the liquid organic fraction. After separation, each of the components can be used independently as fuels for different combustion systems. The liquid portion of the mixture will continue to carry minute, inseparable particles of char and can be used in liquid-fired combustion systems or as a feedstock. It will be realized that the liquid portion, when used as a fuel, can be combusted alone or combined with liquid petroleum distillates as previously disclosed and/or lower to medium chain alcohols having from 1 to about 10 carbon atoms, such as those produced from grain or from coal or bio-waste synthesis processes, to enhance certain fuel characteristics for a particular application. The separated char (or carbonaceous material/char mixture if carbonaceous material has been added to the slurry system) can be burned alone or with a mixture of particulate carbonaceous material such as raw coal, upgrade coals, coke, petroleum coke or the like in standard solid-fueled combustion systems. By admixing the char with one or more of these carbonaceous materials, a high quality compliance product can be obtained even if the admixed material is low in BTU and/or high in sulfur.

In accordance with a further advantageous aspect of the instant invention, either the liquid organic material and/or the solid particulate char which is not admixed to form the slurry can each be used as a fuel for external combustion devices. In accordance with this aspect, some or a substantial portion of the char produced in pyrolysis or hydropyrolysis can be used directly as a fuel for solid-fueled external combustion devices. When certain ranks of coal are employed or certain slurry compositions are desired, excess char may be produced. In accordance with this aspect, the char to be fired directly as a solid fuel need not be ground or sized. It may be mixed with other particulate carbonaceous material and transported to the end-use destination by rail car, truck or the like. Advantageously, the char is transported pneumatically. In a particularly advantageous embodiment, the hot char is fed directly to a mine mouth combustion system, either with or without the addition of coal, upgraded coal and the like by use of a pneumatic conveyance device. In accordance with a further aspect of this embodiment, as previously set forth herein, an amount of the liquid organic fraction which is effective to enhance combustion characteristics and prevent moisture absorption can be admixed with the char or upgraded coals. Preferably the higher boiling fraction is used to coat the char. This helps reduce the viscosity of the remaining liquid organic material. In accordance with this aspect, the dehydrated lignites and upgraded peats are advantageously coated with the organic material obtained from the pyrolysis. This not only enhances the combustion characteristics, but also prevents explosion hazards previously referred to in the prior art. These enhanced materials, as previously set forth, can be slurried or can be compressed into a pelletized form.

In accordance with this aspect, the dehydrated lower rank coals and/or upgraded waste coals are admixed with a binding amount of the higher boiling pyrolysis liquids to form an enhanced fuel material which is compressed, preferably under heat and advantageously in the presence of an amount of a thermally activated binder, to form an agglomerated pelletized fuel product. Advantageously, when the agglomerated product is to be transported pneumatically, it is in the range of $\frac{1}{8}''$ to $\frac{1}{4}''$ outside diameter. For transport by rail, the pellet is advantageously $2\times0''$.

Likewise, it may prove economical not to slurry all or a substantial portion of the liquid organic fraction. As previously described, certain lower boiling fractions such as gasoline and distillates are removed prior to slurrying for use directly as transportation fuels. These fuels are transported in the pipeline by use of plugs and the like to refineries or to end-use combustion devices. Further, a portion (preferably the higher boiling fraction) can be used as a combustion enhancer. In this aspect, the liquid organic fraction is admixed with the char and/or particulate coal to prevent moisture absorption and/or enhance burning characteristics and/or reduce explosion hazard.

In one aspect wherein the hot char is fed directly to a mine mouth external combustion device such as a steam boiler, it is economically advantageous to transport and fire the char (or an enhanced upgrade coal/-char admixture) directly prior to slurrying. In this configuration the pyrolysis process will produce a substantial excess of liquid organic material. In accordance with this embodiment, the higher boiling fraction is used to admix with the char to enhance the combustion characteristics and some or a substantial portion of the liquid organic fraction can be economically transported by means of, for example, the slurry pipeline with plugs between the liquid organic fraction and the slurry or by tanker truck for use directly as a fuel for liquid-fueled external combustion devices or as a feedstock. It will be realized that the liquids can first be "cracked" or hydrotreated to enhance their value as a fuel.

The boiler and heat processors that utilize the instant invention are generally classified as external or internal combustion systems. Any liquid fueled combustion system, such as a conventional oil-fired boiler or diesel engine, wherein the fuel is atomized in minute droplets will be able to utilize the fluidic fuel system, either with or without the particulate coal char, of the instant invention. Any solid fueled combustion systems which will burn high BTU coal will be able to utilize the char or coal/char solid fuel of the instant invention. Since coal is at most a minor constituent or has been beneficiated in accordance with a preferred embodiment, scrubbers and de-slaggers are not deemed necessary for most applications. It has been observed that for most particulate chars, ash is released as fly ash and does not slag boilers.

It will be realized the systems designed for burning coal-oil mixtures will utilize the fluidic fuel system of the instant invention most readily. Char has a higher ignition point than coal but is more reactive. The particulate char (depending upon the characteristics of the coal from which it is derived) will contain in excess of about 10% by weight of the slurry liquid phase. The residual liquid organic fraction which is absorbed by the char appears to facilitate ignition as well as to increase the heat value and reduce explosion hazard.

It will be realized by the skilled artisan that slight modification to oil-fired systems may be necessary to avoid system derating if the fuel system of the instant invention is fired directly into the combustion system. These modifications are dramatically less than those required to burn coal/water slurries and mainly revolve around the fact that minute solid particles are introduced into the chamber, potentially changing the firing characteristics. Because of the higher ignition point and higher reactivity of the char, loading of char in the liquid may be varied or a substantial portion of the char may be removed to accomodate the ignition and combustion characteristics of the boiler system, thereby avoiding the necessity of modifying the boiler system.

It will be further realized that the above fuels, either individually or in combination, are combusted in combustion devices using oxygen. Oxygen, as that term is used herein, is meant to include atmospheres of pure oxygen as well as atmospheres having a partial pressure of oxygen, such as, for example, air.

A particularly advantageous aspect of the instant invention relates to the flexibility of the instant transportable fuel system. The process for making the slurry compositions is internally self-contained, i.e., it uses predominantly the constituents of the coal. lignite, waste coal or peat feedstock, including process heat generated from those carbonaceous materials; in most cases requires no external water; and utilizes almost all by-products of the process in the product, thus does not produce any "sludge" or polluting liquors which must be removed. The transportable fuel system can be "adjusted" or "fine tuned" during the process, prior to transportation or at the end-use facility. The fuel system facilitates transporting coal-derived fuels to both liquid fueled and solid fueled combustion systems as well as providing a useful feedstock. The fuel is uniform and non-polluting. The components can be beneficiated to remove harmful constituents, thus avoiding the $SO_2$ and $NO_x$ pollutants linked with acid rain as well as ash related boiler slagging problems. There is no preclusion against exporting the fuel system and export is easily accomplished using conventional transportation means for liquid fuels. The fuel system utilizes all ranks of coals, including lower ranks and coals not previously thought economically viable.

While the invention has been explained in relation to its preferred embodiment it is understood that various modifications thereof will become apparent to those skilled in the art upon reading the specification and the invention is intended to cover such modifications as fall within the scope of the appended claims.

We claim:

1. A combustible, fluidic, substantially non-polluting fuel system comprising a liquid/solid mixture, including a portion of a solid particulate coal char obtained by pyrolysis of lignites, peats, low rank coals, waste coals and mixtures thereof, dispersed in an amount of a liquid material effective to produce a transportable composition, wherein said liquid material is at least partially derived from said pyrolysis; or is a mixture of said pyrolysis material with a lower chain alcohol of from 1 to 4 carbon atoms.

2. The fuel system of claim 1 further comprising a portion of a particulate carbonaceous material selected from the group consisting of raw coal, upgraded coal, petroleum coke, enhanced dehydrated lower rank coals and mixtures thereof.

3. The fuel system of claim 1 wherein at least a portion of said solid is separated from said liquid/solid mixture at the destination for use as a solid fuel.

4. The fuel system of claim 1 wherein said liquid/solid mixture further comprises a portion of a combustible liquid selected from liquid petroleum distillates, lower and medium chain alcohols having from about 1 to about 10 carbon atoms, and mixtures thereof.

5. The fuel system of claim 2 wherein said liquid/solid mixture further comprises a portion of a combustible liquid selected from liquid petroleum distillates, lower and medium chain alcohols having from about 1 to about 10 carbon atoms, and mixtures thereof.

6. The fuel system of claim 1 wherein the liquid material is at least partially derived by the hydropyrolysis of coal.

7. The fuel system of claim 1 wherein the solid portion is sized to effect bimodal or trimodal packing and both the solid and the pyrolysis liquid material are beneficiated.

8. The fuel system of claim 2 wherein the solid portion is sized to effect bimodal or trimodal packing and both the solid and the pyrolysis liquid material are beneficiated.

9. The fuel system of claim 1 wherein said lower chain alcohol is produced by the catalyzed reaction of coalderived gas, coal pyrolysis gas, natural gas or mixtures thereof.

10. The fuel system of claim 1 wherein said particulate coal char is coated with an amount of a material effective to reduce absorption of said liquid organic material.

11. The fuel system of claim 1 wherein said char and said pyrolysis liquid are at least partially derived from hydropyrolysis in the presence of hydrogen, water, a hydrogen donor or mixtures thereof.

12. The fuel system of claim 2 wherein said char and said pyrolysis liquid are at least partially derived from hydropyrolysis in the presence of hydrogen, water, a hydrogen donor or mixtures thereof.

13. A method of producing a substantially non-polluting combustible, fluidic fuel system comprising the steps of admixing a particulate coal char, derived from the pyrolysis of lignites, peats, low rank coals, waste coals and mixtures thereof, with an amount of a liquid material effective to produce a transportable composition to form a liquid/solid mixture, wherein said liquid material is at least partially derived from the pyrolysis of coal or is a mixture of said pyrolysis material with a lower chain alcohol of from 1 to about 4 carbon atoms.

14. The method of claim 13 comprising the further step of admixing with said liquid/solid mixture a portion of a particulate carbonaceous material selected from coal, upgraded coal, petroleum coke, enhanced dehydrated low rank coals and mixtures thereof.

15. The method of claim 13 comprising the further steps of transporting said system and separating from said system at least a portion of the solid for use as a solid fuel.

16. The method of claim 13 comprising the further step of admixing with said liquid/solid admixture at least a portion of a combustible liquid selected from liquid petroleum distillates, lower and medium chain alcohols having from about 1 to about 10 carbon atoms, and mixtures thereof.

17. The method of claim 13 wherein said liquid material is at least partially derived from the hydropyrolysis of coal.

18. The method of claim 13 wherein said lower chain alcohol is derived at least in part from the catalyzed reaction of coal derived gas, coal pyrolysis gas, natural gas or mixtures thereof.

19. A method for producing a substantially nonpolluting combustible, fluidic fuel system comprising the steps of (a) subjecting a carbonaceous material selected from the group comprising lignites, peats, low rank coals, waste coals and mixtures thereof to pyrolysis to produce a char, a pyrolysis liquid and a hydrocarbon containing gas;

(b) treating the char to produce a particulate material;

(c) admixing said particulate char and said liquid to form said completely combustible fluidic fuel system.

20. The method of claim 19 wherein said carbonaceous material is subjected to pretreatment prior to pyrolysis to remove excess moisture.

21. The method of claim 19 wherein said carbonaceous material is subjected to pretreatment prior to pyrolysis to beneficiate said carbonaceous material.

22. The method of claim 20 wherein said pretreatment to remove excess moisture is accomplished by dry steam treatment of the carbonaceous material.

23. The method of claim 19 wherein said pyrolysis is hydropyrolysis and is carried out in the presence of compounds selected from the group consisting of water, hydrogen-donating compounds, hydrogen and mixtures thereof.

24. The method of claim 19 further comprising the steps of removing from said pyrolysis liquid the lower boiling transportation fuels selected from the group consisting of gasoline and middle distillates prior to performing said admixing step.

25. The method of claim 19 further comprising the steps of beneficiating said liquid and said char prior to performing said admixing step.

26. The method of claim 23 wherein said carbonaceous material is subjected to a preheating step at temperatures of from about 100° C. to about 220° C. at pressures of from about 0.1 to about 0.9 atmospheres.

27. The method of claim 26 comprising the further step of presoaking the coal in the presence of a saturated steam atmosphere at atmospheres of from about 40 to 60 atmospheres and at temperatures in the range from about 200° C. to 400° C. after the preheating step and prior to said pyrolysis step.

28. The method of claim 19 further comprising the step of coating said char prior to performing said admixing step with an amount of a sealant material effective to substantially diminish the absorption of said liquid by said char.

29. The method of claim 19 further comprising the step of admixing a particulate carbonaceous material selected from raw coal, upgraded coal, coke, petroleum coke, enhanced dehydrated low rank coal and mixtures thereof with said char prior to said admixing step.

30. The method of claim 19 comprising the further step of admixing with said liquid/char admixture at least a portion of a combustible liquid selected from liquid petroleum distillates, lower and medium chain alcohols having from about 1 to about 10 carbon atoms and mixtures thereof.

31. The method of claim 30 wherein at least a portion of said organic liquid further comprises a portion of an alcohol having from about 1 to about 4 carbon atoms produced from the catalytic synthesis of said gas.

32. A solid combustion fuel comprising a char obtained from pyrolysis of carbonaceous material selected from lignites, peats, low rank coals, waste coals, and mixtures thereof, admixed with an amount of a liquid material, at least a portion of which is obtained from said pyrolysis, effective to enhance the heat value of said char and to reduce explosion hazard.

33. The fuel composition of claim 32 wherein excess moisture has been mechanically removed from said carbonaceous material prior to said pyrolysis.

34. The fuel composition of claim 32 wherein excess moisture has been removed by dry steam treatment of said carbonaceous material prior to said pyrolysis.

35. A solid combustion fuel comprising a dehydrated low rank coal admixed with an amount of a liquid organic material, at least a portion of which is obtained from pyrolysis of coal, effective to enhance the heat value of said coal and reduce explosion hazard.

36. The fuel composition of claim 35 wherein said dehydrated, enhanced coal has been compressed to form an agglomerated solid fuel product.

37. The fuel composition of claim 36 wherein said compression is accomplished in the presence of heat.

38. The fuel composition of claim 35 wherein said coal has been dehydrated by mechanical means prior to being admixed with said liquid organic material.

39. The fuel composition of claim 35 wherein said coal has been dehydrated by dry steam treatment prior to being admixed with said liquid organic material.

* * * * *